United States Patent [19]

Theurer

[11] Patent Number: 4,773,333

[45] Date of Patent: Sep. 27, 1988

[54] SELECTIVE PRODUCTION TAMPER MACHINE AND A TAMPING HEAD THEREFOR

[75] Inventor: Josef Theurer, Vienna, Austria

[73] Assignee: Franz Plasser Bahnbaumaschinen-Industriegesellschaft m.b.H., Vienna, Austria

[21] Appl. No.: 839,898

[22] Filed: Mar. 14, 1986

[30] Foreign Application Priority Data

Mar. 25, 1985 [EP] European Pat. Off. ..... 85890076.4
Jul. 19, 1985 [EP] European Pat. Off. ..... 85890160.6

[51] Int. Cl.[4] ..... E01B 27/16
[52] U.S. Cl. ..... 104/12
[58] Field of Search ..... 104/10, 12, 13, 11, 104/18; 403/373, 15, 396; 404/133

[56] References Cited

U.S. PATENT DOCUMENTS

| | | | |
|---|---|---|---|
| 2,082,947 | 6/1937 | Fotsch | 403/396 X |
| 3,357,366 | 12/1967 | Plasser et al. | 104/12 |
| 3,534,687 | 10/1970 | Plasser et al. | 104/12 |
| 3,808,976 | 5/1974 | Stewart | 104/12 |
| 4,248,155 | 2/1981 | Theurer | 104/12 |
| 4,282,815 | 8/1981 | von Beckmann | 104/12 |
| 4,369,712 | 1/1983 | von Beckmann | 104/12 |
| 4,428,297 | 1/1984 | Ganz | 104/12 |
| 4,466,355 | 8/1984 | Pasquini | 104/12 |
| 4,537,135 | 8/1985 | Theurer | 104/12 |
| 4,576,095 | 3/1986 | Theurer | 104/12 |
| 4,598,645 | 7/1986 | Ganz | 104/12 |

FOREIGN PATENT DOCUMENTS 3313114 3/1984 Fed. Rep. of Germany .

*Primary Examiner*—Robert B. Reeves
*Assistant Examiner*—Scott H. Werny
*Attorney, Agent, or Firm*—Collard, Roe & Galgano

[57] ABSTRACT

A production tamper for selectively tamping ballast simultaneously underneath two successive ties or underneath a single tie with a tamping head comprising a common tamping tool carrier, two pairs of opposed vibratory tamping tools mounted on the common tamping tool carrier laterally adjacent the sides of a rail, the pairs of tools being spaced from each other in the direction of elongation of the track so that the adjacent tools of the two pairs may be immersed in a respective crib defined between adjacent ties, and the transversely aligned remote tamping tools of at least one of the pairs being adjustable independently from the other tamping tools for movement between a lowered operative and a raised inoperative position. An adjustment drive is connected to each adjustable remote tamping tool for moving the same, reciprocating drives are connected to the opposed tamping tools, a common drive vibrates the tamping tools, and a drive is provided for vertically adjusting the tamping tool carrier.

22 Claims, 4 Drawing Sheets

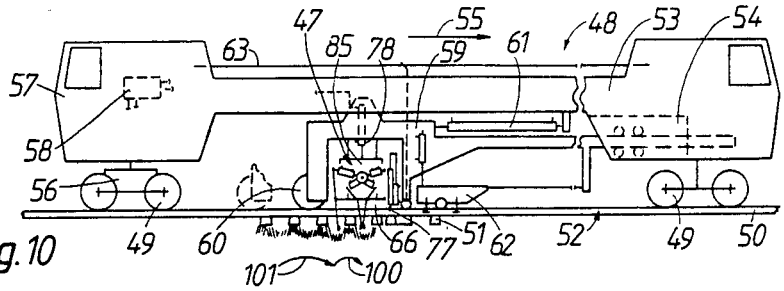
Fig. 10
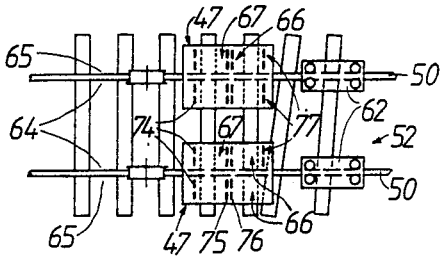
Fig. 11
Fig. 12
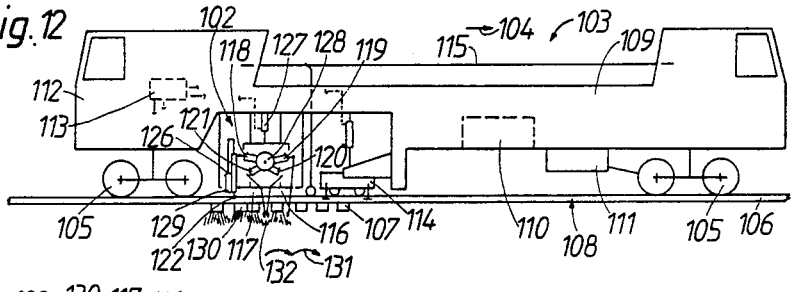
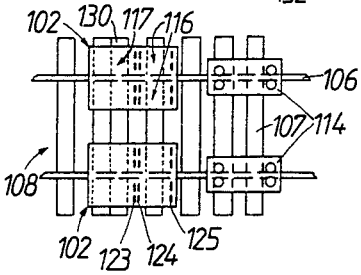
Fig. 13
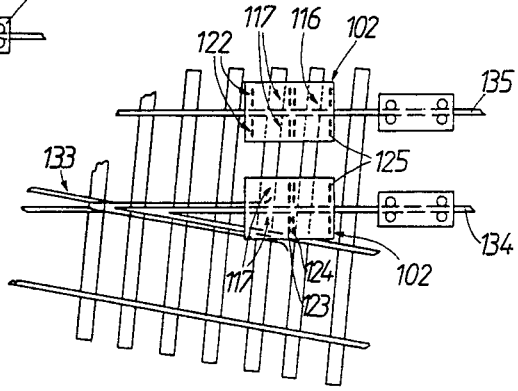
Fig. 14

SELECTIVE PRODUCTION TAMPER MACHINE AND A TAMPING HEAD THEREFOR

BACKGROUND OF THE INVENTION

The present invention relates to a production tamper machine for selectively tamping ballast simultaneously underneath two successive ties or underneath a single tie of a track including a plurality of spaced ties resting on the ballast and defining cribs between adjacent ones of the spaced ties, and rails having a gage side and a field side, the rails being fastened to the ties. The machine comprises a respective tamping head associated with each rail and operative for production tamping. Each tamping head comprises a common tamping tool carrier, two pairs of opposed vibratory tamping tools mounted on the common tamping tool carrier laterally adjacent each side of the associated rail, the tamping tools of the pairs of tools on one rail side being transversely aligned with the tamping tools of the pairs of tools on the other rail side, the tamping tools including tamping pick means with tamping jaw means wide enough for effective production tamping, the pairs of tools being spaced from each other in the direction of elongation of the track, with one of the opposed tools of one of the pairs being adjacent one of the opposed tools of the other pair while the other tools of the pairs of opposed tools are remote from each other. The spacing between the pairs of tools is such that the adjacent tools of the two pairs may be immersed in a respective one of the cribs defined between the adjacent ties, the opposed tools of each pair being arranged for immersion in the ballast adjacent one of the ties, with the one tie positioned between the opposed tools, and for reciprocation in the direction of elongation of the track. Reciprocating drives are connected to the opposed tamping tools, as well as a common drive for vibrating the tamping tools. A drive is provided for vertically adjusting the tamping tool carrier. This invention also relates to the tamping head for such a production tamper machine.

Tamping heads of this type for tamping two successive track ties simultaneously have been disclosed in U.S. Pat. Nos. 3,357,366 and 3,372,651. In U.S. Pat. No. 3,357,366, twin tamping tools are used on each side of the rails. Productiсn tampers incorporating such tamping heads have been used commercially with great success because their operation not only considerably increases the tamping efficiency but also enhances the uniformity of the ballast compaction underneath the ties because two adjacent tamping tools are immersed in the same crib and are simultaneously reciprocated in opposite directions. However, when such machines are used for tamping track having quite irregular crib widths and/or obliquely disposed ties and/or at double ties disposed under rail joints, difficulties have been encountered because it is then not always possible readily and rapidly to center the tamping tools properly so as to assure proper tie tamping and to avoid possible damage to the ties.

As is common in this art, the term "production tamper" or "production tamping" used throughout the specification and claims refers to tamping ballast along stretches of tangent or curved track in regular track rehabilitation work, in contrast to such specialty tampers as "switch tampers" designed for work in track switches. Production tamping can be effected only with tamping tools which include tamping pick means with tamping jaw means wide enough for effective ballast tamping, i.e. equivalent to twin tamping picks at each side of the rails. While production tampers have been designed for working also in track switches, certain specialty tampers can work only under the special tamping conditions for which they are designed.

U.S. Pat. No. 3,534,687 deals with a switch tamper designed to tamp two adjacent ties simultaneously. The tamping head of this machine provides only a single tamping tool at each side of the rails and these tamping tools may be pivoted upwards in a plane extending perpendicularly to the plane of reciprocation of the tamping tools. A hydraulic cylinder-piston adjustment drive is linked to each tamping tool for pivoting the same. The tamping head is mounted with a track correction reference system on a machine frame portion which is cantilevered over the track section to be corrected and tamped, and which is laterally pivotal on a main machine frame portion to enable the tamping tools to be properly centered in track switches. Adequate production tamping is impossible with this machine and, in addition, the machine requires 16 separate adjustment drives with associated bearings and controls, wherefore this machine has proved not to be commercially feasible.

U.S. Pat. No. 4,282,815 discloses a production tamper machine designed for simultaneously tamping two successive ties. For this purpose, closely adjacent single-tie tamping tool assemblies are vertically adjustably mounted on a common frame and separate drives are used for the vertical adjustment of each tamping tool assembly. Each tamping tool assembly comprises two pairs of opposed vibratory twin tamping tools arranged for reciprocation in the direction of track elongation, the pairs of tools being laterally adjacent the gage and field sides of the rails, and the opposed tools of each pair being arranged for immersion in the ballast adjacent a respective tie, with the tie positioned between the opposed tools. This structure requires not only two vertical adjustment drives but also eight vibrating drives, i.e. two vibrating drives for each pair of tamping tools, which makes it quite expensive to build and service. It has the added disadvantage that the adjacent tamping tools of the pairs cannot be disposed sufficiently close to each other—due to the special types of reciprocating and vibrating drives used—to enable the machine to assure trouble-free reciprocation of the tamping tools and operation as a tamper for two successive ties if the crib widths differ substantially. Each tamping tool assembly may be independently lowered and operated but the construction is such that the vertical adjustment of the tamping tool assemblies may be obstructed. Tamping machines of the type disclosed in this patent have not been commercially successfully used in the simultaneous tamping of two successive ties, much less for successively tamping single ties.

U.S. Pat. No. 4,466,355 discloses a tamping unit comprising a vertically adjustable tamping tool carrier frame supporting two transversely adjacent tamping picks forming a twin tamping tool for immeriion at one side of the rail adjacent a respective tie, one of the tamping picks of the twin tamping tool being vertically retractible by an additional vertical adjustment drive. This so-called half tamping unit enables only one side of the rail/tie intersection to be tamped. Tamping units of this type are useful only for small tampers designed for tamping single ties at one side of the rail, and when they are alternately used at the right and left side of the rail, they cause considerable ballast dislocations, making proper tamping and the provision of a solid ballast bearing for the rail/tie intersection impossible.

My effectively copending U.S. Pat. No. 4,537,135, dated Aug. 27, 1985, for the first time disclosed a commercially successful tamping head universally useful for production and switch tamping, the tamping head comprising eight independently laterally pivotal tamping tools which may be selectively operated for tamping in switch areas or for production tamping. However, this tamping head can be used only for tamping one tie at a time.

Finally, one embodiment disclosed in my copending U.S. Pat. No. 4,643,101 dated Feb. 17, 1987 comprises a high-efficiency mobile track leveling, lining and tamping machine which advances continuously along a track while its tamping head advances intermittently from tamping station to tamping station and is designed for simultaneous tamping of two successive ties. Such machines are very useful in rehabilitation operations on high-speed tracks. A properly centered and trouble-free immersion of the tamping tools in the ballast is of particular importance in the operation of these machines which work at high speeds and require avoidance of obstacles and difficulties of any kind in the disposition of the tamping tools in the cribs.

SUMMARY OF THE INVENTION

It is the primary object of the present invention to provide a production tamper machine and a tamping head useful therefor which is designed for simultaneously tamping two successive ties while being convertible in a simple manner to tamp a single tie, the arrangement assuring improved operating conditions and enabling the rapid conversion between the two operating modes while the tamping operation proceeds.

In a production tamper machine and a tamping head operative for production tamping of the first-described type, the above and other objects are accomplished in accordance with this invention by arranging the adjacent tools of the two pairs vertically fixed in relation to the common tamping tool carrier and the transversely aligned remote tamping tools of at least one of the pairs of opposed vibratory tamping tools adjustably independently from the other tamping tools for moving the remote tamping tools between a lowered operative and a raised inoperative position. A respective adjustment drive is connected to the vertically adjustable remote tamping tools for moving the same between the operative and inoperative positions. A respective pair of opposed tamping tools is arranged laterally adjacent the gage side and the field side of each rail, respective tools on the gage side and the field side being laterally aligned, and each tamping tool preferably comprises a tool holder and the tamping pick means with tamping jaw means is constituted by twin tamping picks with respective tamping jaws mounted on the holder, the adjustment drive being connected to the holder of the adjustable remote tamping tool for moving the same.

Such a ballast tamping machine is a truly universally operable tamper whose tamping head has practically proven, excellent capability for simultaneously tamping two successive ties while it may be readily converted for tamping a single tie simply by raising or retracting the trailing or leading remote tamping tools of the pairs of opposed tamping tools, as track conditions may require. In this manner, such a universal tamper may be used very efficiently and effectively in transition zones between tangent track and track switch sections as well as for tamping double-ties at rail joints, without encountering any obstacles or centering difficulties. The tamping head of the invention has the added advantage of a simple and proven construction. Moreover, the adjacent tamping tools of the two pairs of opposed tamping tools may be so closely spaced that they may be easily immersed in the crib adjacent a single tie to be tamped without constituting any obstacle. In this case, the single tie may be tamped merely by reciprocating the associated remote tamping tools towards the single tie while the adjacent tamping tools immersed in the crib on the other side of the single tie cause ballast compaction towards the bottom of this crib.

BRIEF DESCRIPTION OF THE DRAWINGS

The above and other objects and advantages of the present invention will become more apparent in the following detailed description of certain now preferred embodiments thereof, taken in conjunction with the accompanying, partially schematic drawing wherein

FIG. 10 is a view similar to that of FIG. 1 of a continuously advancing track leveling, lining and tamping machine equipped with the tamping head of FIGS. 7 to 9 operative for production tamping two successive ties simultaneously;

FIG. 11 is a fragmentary top view of FIG. 10, similar to FIG. 2;

FIG. 12 is a view similar to that of FIGS. 1 and 10 of an intermittently advancing track leveling, lining and tamping machine equipped with a tamping head operative for production tamping according to this invention;

FIG. 13 is a fragmentary top view of FIG. 12, similar to FIGS. 2 and 11; and FIG. 14 is a similar view showing the tamping heads in operation in a track switch.

DESCRIPTION OF THE PREFERRED EMBODIMENTS

Figure 1:
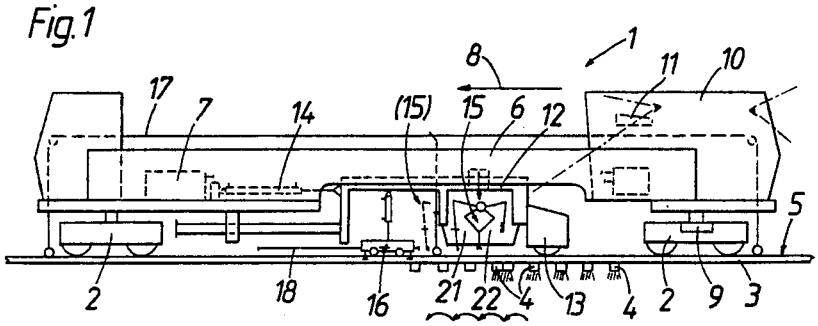
FIG. 1 is a generally diagrammatic side elevational view of one embodiment of a production tamper machine according to this invention.

Referring now to the drawing and first to FIG. 1, there is shown continuously advancing track leveling, lining and tamping machine 1 capable of operating as a production tamper machine for tamping ballast underneath track 5 including a plurality of spaced ties 4 resting on the ballast and defining cribs between the adjacent ties, and rails 3 fastened to the ties. Machine 1 has elongated main machine frame 6 whose ends are supported on swivel trucks 2 for mobility along the track in an operating direction indicated by arrow 8. Main machine frame 6 carries power plant 7 and the controls for operating all of the machine tools as well as drive 9 for advancing the main machine frame in the operating direction. Operator's cabs are mounted on the main machine frame at the respective ends thereof, main cab 10 at the rear end of the main machine frame, in the operating direction, being equipped with main control panel 11 which is connected to a central control for operating the machine tools and driving the machine.

Satellite or auxiliary frame 12, which is also elongated, is arranged between swivel truck undercarriages 2, 2 which are spaced far apart. The auxiliary frame carries all the track leveling, lining and tamping tools. The rear end of auxiliary tool carrying frame 12, in the operating direction, is supported on track 5 by a pair of wheels 13 supporting and guiding frame 12 along the track, and main operator's cab 10 is partly cantilevered over the rear end of the auxiliary frame. The front end of the auxiliary tool carrying frame is longitudinally displaceably and laterally pivotally connected to, and supported on, main machine frame 6 by means of longitudinally adjustable coupling device 14 which is constituted by a double-acting hydraulic drive whose piston rod is linked to a forwardly projecting pole member of auxiliary frame 12.

To enable machine 1 to operate as a production tamper capable of production tamping two successive ties 4 simultaneously in intermittent stages indicated by short arrows 38 while main machine frame 6 advances non-stop in the operating direction indicated by arrow 8, auxiliary frame 12 carries tamping heads 15 operative for production tamping and respectively associated with rails 3. Track leveling and lining unit 16 precedes the tamping heads in the operating direction and is carried by auxiliary frame 12 for vertical and lateral adjustment with respect to the auxiliary frame to enable track 5 to be leveled and/or lined under the control of a track correction reference system illustrated to comprise reference wires 17 and 18.

Figure 4:
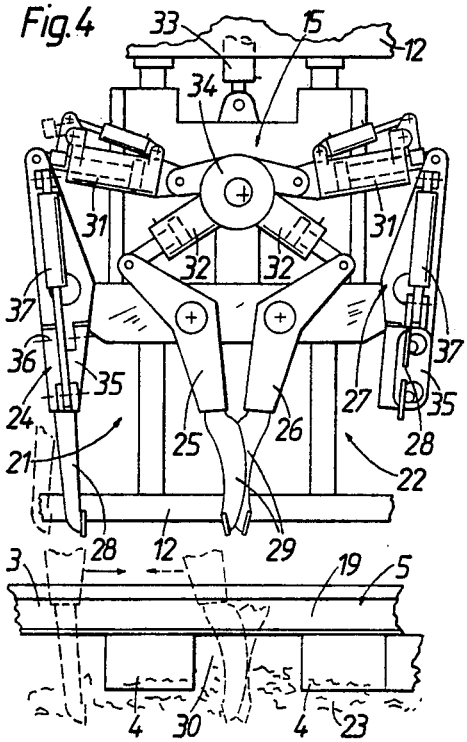
FIG. 4 is an enlarged side elevational view of a tamping head of the production tamper machine of FIG. 1 in an operative position for tamping a single tie, with the remote tamping tools of the pairs of tamping tools trailing in an operating direction being raised.
Figure 5:
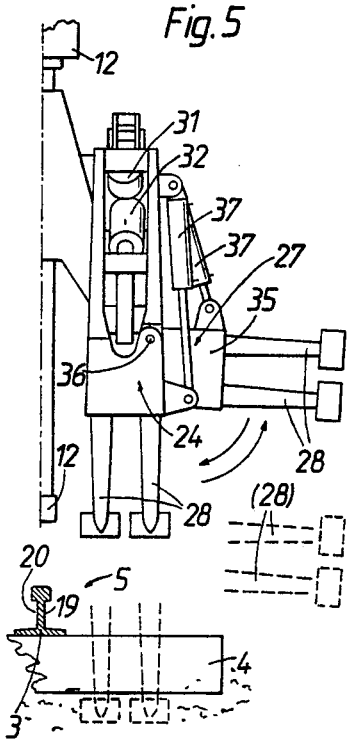
FIG. 5 is an end view of the right half of the tamping head of FIG. 4.
Figure 6:
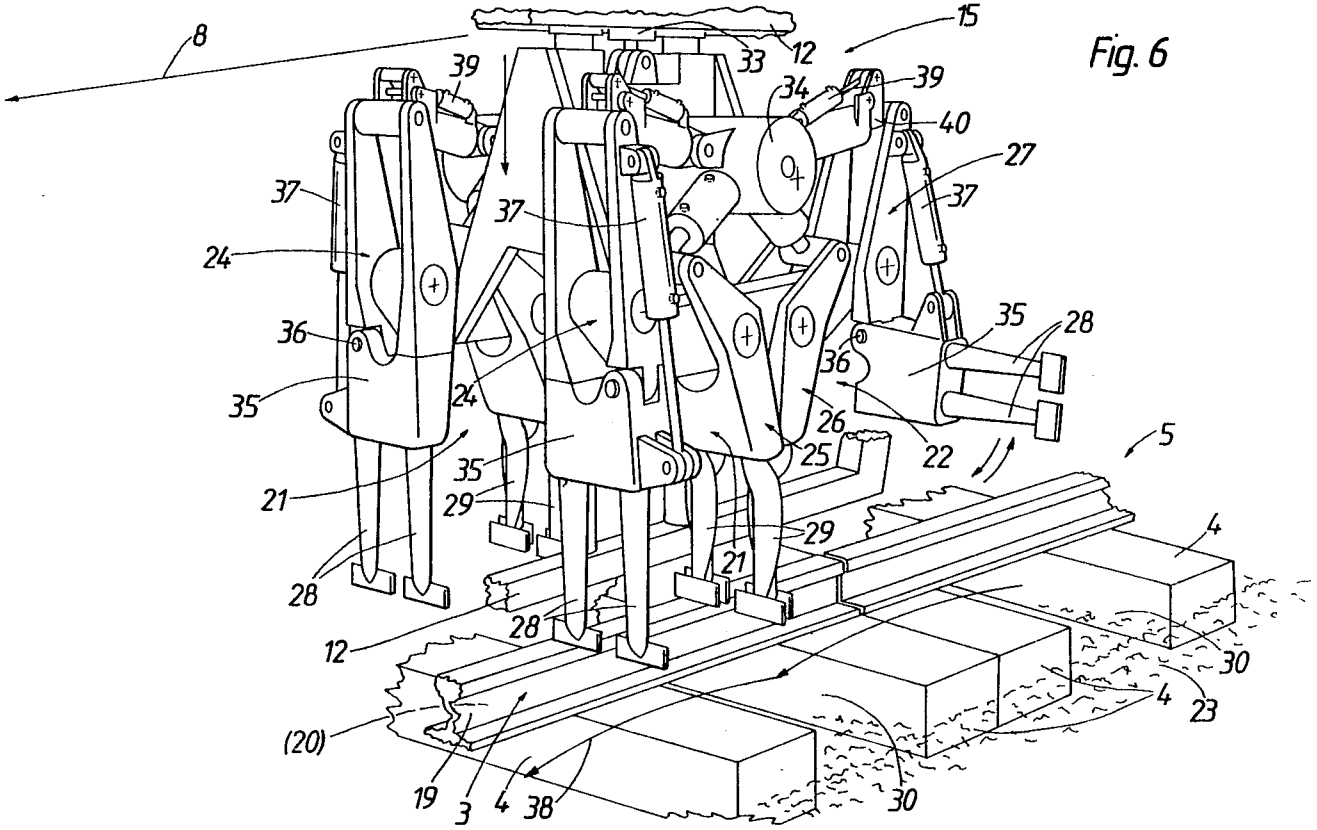
FIG. 6 is a perspective view of the tamping head of FIGS. 4 and 5.

As best shown in FIGS. 4–6, each tamping head 15 comprises a common tamping tool carrier and two pairs 21, 22 of opposed vibratory tamping tools 24, 25 and 26, 27 mounted on the common tamping tool carrier laterally adjacent gage and field sides 19 and 20 of rail 3. The tamping tools of pairs 21, 22 of tools on one rail side are transversely aligned with the tamping tools of the pair of tools on the other rail side. The pairs of tools are spaced from each other in the direction of elongation of track 5, with opposed tool 25 of pair 21 being adjacent opposed tool 26 of the other pair 22 while the other tools 24 and 27 of the pairs 21, 22 of opposed tools are remote from each other. The spacing between the pairs of tools is such that adjacent tools 25, 26 of the two pairs may be immersed in crib 30 defined between adjacent ties 4, the opposed tools 24, 25 and 26, 27 of each pair being arranged for immersion in ballast 23 adjacent one of the ties, with one tie 4 positioned between the opposed tools, and for reciprocation in the direction of elongation of the track. Reciprocating drives 31 and 32 are connected to the opposed tamping tools, common drive 34 is provided for vibrating the tamping tools and drive 33 mounts the common tamping tool carrier on auxiliary frame 12 for vertically adjusting the carrier for immersion of the tamping tools in the ballast.

As best shown in FIG. 6, the tamping tools include tamping pick means 28 with tamping jaw means wide enough for effective production tamping. In the preferred and illustrated embodiment, each tamping tool 24, 27 comprises tool holder 35 and twin tamping picks 28, 28 mounted on the holder while tamping tools 25, 26 have twin tamping picks 29, 29 which are preferably cranked to enable the adjacent tamping tools to assume the illustrated end position wherein the cranked tamping picks overlap in the direction of elongation of the track and the adjacent tamping tools are closest to each other.

According to the invention, adjacent tools 25, 26 of the two pairs are verticaly fixed in relation to the common tamping tool carrier while transversely aligned remote tamping tools 24 and 27 of pairs 21, 22 are vertically adjustable independently from the other tamping tools for moving the remote tamping tools between an operative position and an inoperative position. Respective adjustment drive 37 is connected to each vertically adjustable remote tamping tool for moving the same. In the preferred and specifically illustrated embodiment, adjustment drive 37 is connected to holder 35 of the remote tamping tool. In this embodiment, pivoting axle 36 bears holder 35 and this axle extends perpendicularly to the direction of reciprocation of the opposed tamping tools whereby adjustment drive 37 may laterally pivot each remote tamping tool in a plane extending perpendicularly to the direction of reciprocation of the opposed tamping tools. As shown, all the drives are hydraulically operated and an outer end of the piston rod of hydraulic cylinder-piston drive 37 is linked to a bracket affixed to holder 35 while the drive cylinder is linked to an upper end of a fixed portion of the tamping tool.

This structure and operation of the remote tamping tool is particularly simple and the illustrated pivoting arrangement has been found effective in working in switches. While leading remote tamping tools 24 of the pairs of opposed tamping tools have been shown as being vertically adjustable in the same manner as trailing remote tamping tools 27, it is possible to make only the trailing remote tamping tools so adjustable for moving them into an inoperative position. This enables the tamping head operative for production tamping to be converted readily from an operational mode in which two successive ties are simultaneously tamped to an operational mode in which only a single tie is tamped, simply by raising the trailing remote tamping tools. In this operational mode, the tamping of the single tie during each intermittent tamping cycle is improved since the ballast in crib 30 trailing tie 4 to be tamped (see FIG. 4) is compacted downwardly, i.e. towards the subgrade of the track bed. When all drives are hydraulically operated, the central control of the machine operation is simplified.

FIG. 6 illustrates tamping head 15 in raised position, i.e. the piston of cylinder-piston vertical adjustment drive 33 for the common tamping tool carrier is retracted. The operating direction is indicated by arrow 8 and the two trailing remote tamping tools 27 of trailing pairs 22 of opposed vibratory tamping tools have been pivoted into their inoperative position by operation of vertical adjustment drives 37. Trailing tie 4 and immediately preceding double-tie 4, 4 under the illustrated rail joint were previously tamped by intermittently advancing the tamping head, as indicated by arrows 38, with six tamping tools in operative position for immersion in the ballast and the two trailing tamping tools 27 raised into their inoperative position. In the tamping cycle for tamping the double-tie at the rail joint, auxiliary cylinder-piston drives 39 with their associated spacers 40 are operated to move tamping tools 27 farther from opposed tamping tools 26 to enable the opposed tamping tools to be immersed in cribs 30 adjacent the double-tie without interference. As the perspective view of FIG. 6 clearly illustrates, the penetration of the four cranked tamping picks 29 into the ballast in crib 30 at gage and field sides 19, 20 of rail 3 upon lowering of the common tamping tool carrier will produce an increased compaction of the ballast because of the larger volume of the four picks 29 at each rail side, as compared to only two picks 28. In this manner, the tamping head is operative for production tamping a single tie in each tamping cycle, as schematically shown in FIG. 3, conversion between this mode of operation and that of simultaneously tamping two successive ties being accomplished simply by pivoting tamping tools 27 down into their operative position.

Figure 3:
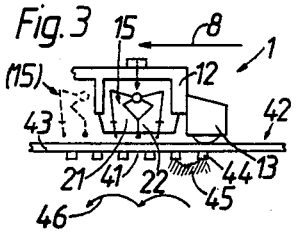
FIG. 3 is a fragmentary side elevational view of FIG. 1, showing a tamping head of the production tamper machine in an operative position for simultaneously tamping two successive ties.
Figure 2:
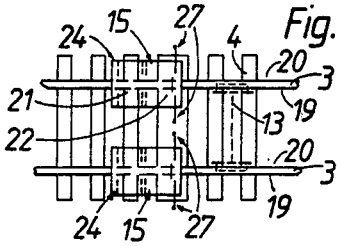
FIG. 2 is a fragmentary top view of FIG. 1, showing the tamping heads operative for production tamping.

FIG. 3 illustrates machine 1 moving along track 42 including a plurality of spaced concrete ties 44 resting on ballast 45 and defining cribs 41 between adjacent ties, and rails 43 fastened to the ties. All the tamping tools are in their operative position so that two successive ties are simultaneously tamped as the machine advances continuously in the operating direction while the tamping heads advance intermittently from tamping cycle to tamping cycle, as indicated by arrows 46, the position of tamping head 15 in the next succeeding tamping cycle being shown in broken lines. While main machine frame 6 advances non-stop during the production tamping, longitudinally adjustable coupling 14 moves auxiliary frame 12 relative to the main frame so that the auxiliary frame will stand still during each tamping cycle while the main machine frame continues to move forward. Obviously, tamping head 15 would remain operative in the same manner as hereinabove described if it were mounted directly on the main machine frame, i.e. if the entire machine would advance intermittently. Thus, the tamping head is universally useful and may be readily adapted during operation to various track conditions. It can be effectively and economically used under normal and adverse operating conditions, including the rehabilitation of tracks with some obstacles, with irregular and/or particularly narrow cribs and with obliquely positioned ties.

Figure 7:
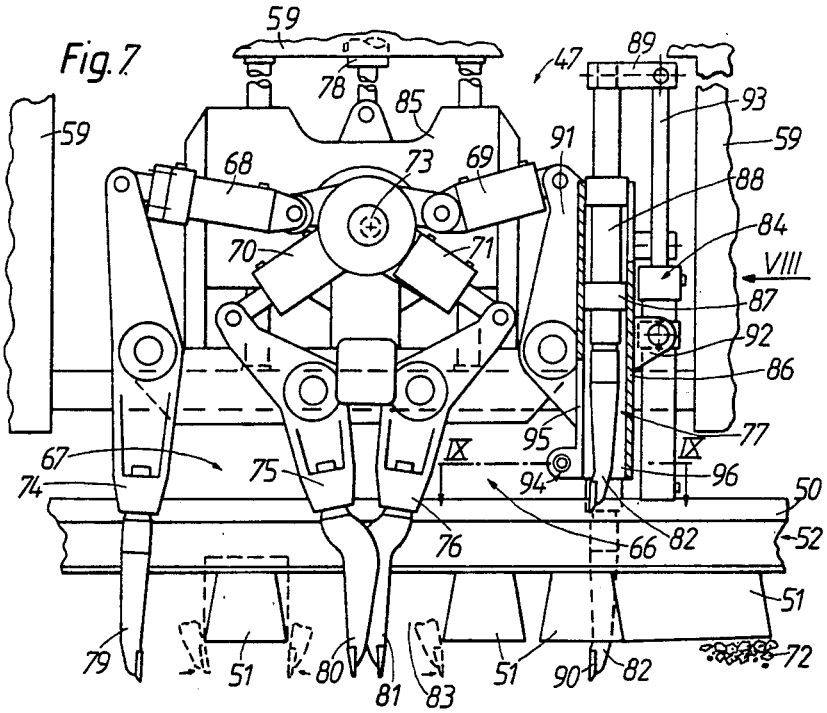
FIG. 7 is a view similar to that of FIG. 4 of another embodiment of the tamping head, partly in section.
Figure 8:
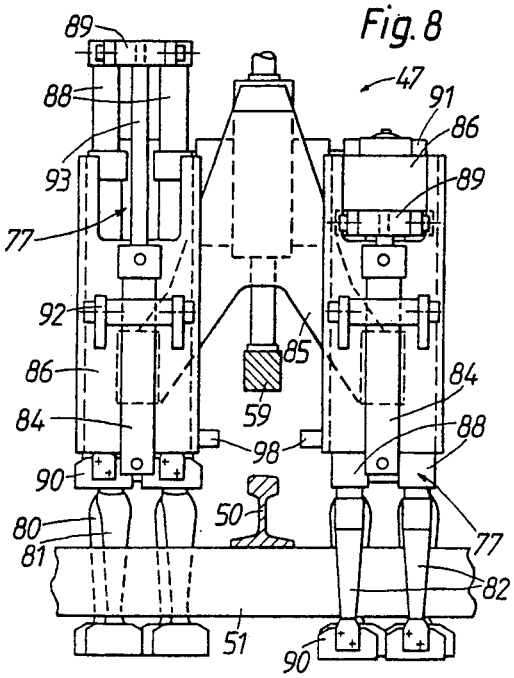
FIG. 8 is a side elevational view of this tamping head, viewed in the direction of arrow VIII of FIG. 7.
Figure 9:
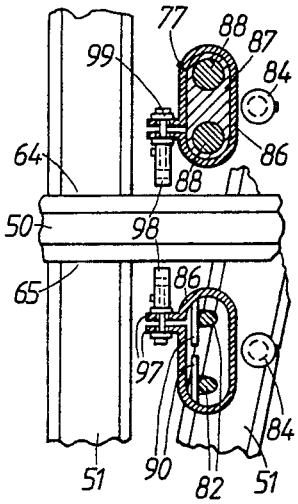
FIG. 9 is a cross sectional view along line IX—IX of FIG. 7.

FIGS. 7 to 9 illustrate another embodiment of a tamping head 47 incorporating independently vertically adjustable tamping tools with twin tamping picks. As shown, two pairs 66, 67 of opposed vibratory tamping tools 74, 75 and 76, 77 are mounted on common tamping tool carrier 85 laterally adjacent gage and field sides 64, 65 of rail 50 fastened to concrete ties 51. The pairs of tools are spaced from each other in the direction of elongation of track 52, with one tool 75 of pair 67 being adjacent one tool 76 of the other pair 66 while the other tools 74 and 77 of pairs 66, 67 of the opposed tools are remote from each other. The spacing between the pairs of tools is such that adjacent tools 75, 76 of the two pairs 66, 67 may be immersed in a respective crib 83 defined between adjacent ties 51, 51, the opposed tools of each pair being arranged for immersion in ballast 72 adjacent one of the ties, with the one tie positioned between the opposed tools. Adjacent tamping tools 75, 76 have cranked twin tamping picks 80 and 81 for common immersion in crib 83 and reciprocation into end positions in a common transverse plane, as more fully described hereinabove in connection with the previously described embodiment. As shown in FIG. 8, these tamping tools with their twin picks are fork-shaped. The opposed tools are also arranged for reciprocation in the direction of elongation of the track. The remote tamping tool 77 of pair 66 is vertically adjustable independently from the other tamping tools for moving this remote tamping tool between an operative and an inoperative position. Adjustment drive 84 is connected to vertically adjustable remote tamping tool 77 for moving the same. Reciprocating drives 68, 69, 70 and 71 are connected to the opposed tamping tools, common drive 73 vibrates all the tamping tools and drive 78 connects common tamping tool carrier 85 to machine frame 59 for vertically adjusting the tamping tool carrier with the tamping tools mounted thereon. Thus, each tamping head 47 with its pairs 66, 67 of tamping tools, reciprocating drives 68–71 for the tools and common vibrating and vertical adjustment drives 73 and 78 constitutes a structural unit.

FIG. 10 schematically illustrates non-stop operating track leveling, lining and tamping machine 48 incorporating such a tamping head. This machine comprises elongated heavy machine frame 53 supported at its ends by swivel trucks 49, 49 on track 52 comprised of concrete ties 51 to which rails 50 are fastened. Power plant and operating control arrangement 54 is mounted on machine frame 53 and drive 56 advances machine 48 continuously during the operation thereof in an operating direction indicated by arrow 55. Operator's cab 57 containing control panel 58 is mounted on the machine frame at the rear end thereof, in the operating direction, and the control panel is connected to the power plant and control arrangement by suitable control lines.

Elongated subframe 59 is arranged between undercarriages 49, 49 of main machine frame 53, which are spaced apart a sufficient distance to permit the track displacement required for track leveling and/or lining. A set of a pair of wheels 60 supports and guides a rear end, in the operating direction, of elongated subframe 59 on track 52 while a front end of the elongated subframe is pivotally supported in main machine frame 53 and is longitudinally adjustably linked to the main machine frame by double-acting hydraulic drive 61. The drive provides an adjustment path of the subframe relative to the main frame which is about double the path of intermittent advancement between tamping cycles, which depends on the type of tamping, i.e. tamping of a single tie or of two successive ties in each tamping cycle. Therefore, in the present embodiment, this adjustment path is about four times the width of a crib. As seen in the fragmentary and schematic top view of FIG. 11, machine 48 is equipped with two tamping heads 47 associated with rails 50 for simultaneously tamping two successive ties 51. Elongated subframe 59 also supports track leveling and lining unit 62 which is vertically and laterally adjustable in relation to the subframe to enable track 52 to be leveled and/or lined under the control of a suitable reference system of which leveling reference wire 63 is shown.

In tamping head 47 illustrated in FIGS. 7 to 9, respective pairs 66, 67 of opposed tamping tools are arranged laterally adjacent gage and field sides 64, 65 of rails 50, respective tools 74, 75, 76, 77 on the gage and field sides being laterally aligned. In the illustrated embodiment, only laterally aligned remote tamping tools 77 of pairs 66 of opposed tamping tools leading in the operating direction indicated by arrow 55 in FIG. 10 are vertically adjustable, and each adjustment drive 84 is operable by remote control independently of the other adjustment drives and of drive 78 for vertically adjusting tamping tool carrier 85.

As well shown in FIGS. 10 and 11, this arrangement enables the tamping heads to function without difficulty in track sections which present tamping obstacles, such as oliquely positioned ties, double-ties at rail joints or some track element which would prevent immersion of a tamping tool in the ballast. In this case, selected tamping tools 77 may be simply raised to avoid the obstacle and without interfering with the progress of the tamping operation. The tamping head may be readily installed in all types of production tampers, including conventional intermittently advancing track leveling, lining and tamping machines as well as the newer non-stop operating machines. In the embodiment of FIG. 10, remote tamping tools 77 of the opposed tools of pairs 66 leading in the operating direction are independently vertically adjustable. However, it is also possible to make remote tamping tools 74 of the opposed tools of pairs 67 trailing in the operating direction independently vertically adjustable. Both modifications have their advantages.

The tamping heads of the present invention may be selectively used for tamping only a single tie. In this mode of operation, it is possible merely to immerse adjacent tamping tools 75, 76 of pairs 66, 67 of the opposed tamping tools in ballast 72 in crib 83 without reciprocating the same. This, as previously explained, will provide enhanced compaction of the ballast in the crib. The adaptability of the tamping head to a great variety of different track conditions encountered along a stretch of track in production tamping considerably enhances the productivity of machines equipped with such tamping heads while assuring a very high quality of ballast tamping.

Tamping tools 77 are telescopingly constructed to enable them to be vertically adjustable. As shown, each tamping tool 77 comprises tubular tamping tool holder 86 pivotally mounted on common tamping tool carrier 85 and vertically displaceably holding the tamping tool. This construction is very simple, assures a sturdy guide for the vertical displacement of the tamping tool and the bearings and adjustment drive are protected by the tubular holder against environmental impingements, such as dust and impacts by flying rocks. Connecting bracket 91 is affixed to the holder and pivoted to the common tamping tool carrier, and the bracket is linked to a respective one 69 of the reciprocating drives for the vertically adjustable tamping tool 77 for pivoting the holder. Additional connecting bracket 92 is affixed to holder 86 diametrically opposite bracket 91 and mounts hydraulically operated cylinder-piston jack 84 for each tamping tool 77 to enable each tool to be retracted independently. Cross connection 89 connects piston 93 of jack 84 to an upper end of the tamping tool. This provides a particularly simple and sturdy vertically adjustable tamping tool structure operated by a hydraulic drive, in which the tamping tool holder itself serves to receive the tamping tool telescopingly. The tubular holder provides a rigid and robust construction designed to assure satisfactory operations in situations when the tamping tool is subjected to considerable resistance forces, such as in the immersion and tamping of encrusted ballast. The illustrated connection to the tamping tool carrier is very useful in mounting such a vertically adjustable tamping tool in existing tamping heads since the two pivots conventionally linking the tamping tool to the tamping tool carrier can be used for linking the tamping tool holder thereto.

In the illustrated embodiment, each vertically adjustable remote tamping tool 77 is comprised of twin tool carrying parts 88 attached to cross connection 89, and twin tamping picks 82 replaceably mounted on the tool carrying part, with tamping jaws 90 replaceably mounted on lower ends of the picks. The tool carrying parts may be telescopingly retracted into tubular tool holder 86 up to the tamping jaws, as shown in FIG. 8 where the retracted tool is shown in full lines while the extended tool at the other side of the rail is shown in broken lines. Common bushing 87 vertically displaceably bears twin tool carrying parts 88 whose upper ends are connected to cross connection 89. Cylinder-jack adjustment drive 84 has a stroke enabling the twin tool carrying parts to be telescopingly lowered out of the tubular tool holder and retracted thereinto until the tamping jaws are positioned at the lower holder end. Furthermore, fixing device 94 holds tool 77 respectively in the operative and inoperative position thereof. The illustrated fixing device comprises clamping portion 96 of tubular holder 86 surrounding the tamping tool carrying parts 88 and capable of clamping the tamping tool in the operative position, and mating flanges 97, 97 affixed to tubular holder portion 96. The flanges are movable towards each other for tightening the tubular holder portion around the tamping tool carrying parts whereby the tamping tool is clamped in position. Hydraulically operated cylinder-piston jack 98 moves flages 97 towards each other for tightening tubular holder portion 96 around the tamping tool and this tubular holder portion defines longitudinally extending slot 95 facilitating the tightening of the tubular holder portion. The piston rod of the cylinder of jack 98 affixed to one flange 97 passes through the other flange and has counter-support 99 at the free end thereof. Thus, when a pressure fluid is delivered to the cylinder to apply pressure to the piston, mating flanges 97, 97 are pressed together in the region of slot 95, causing tubular holder 86 to be clamped against common bushing 87 for tool carrying parts 88. As can be seen from the sectioned portion of FIG. 7, tamping tool 77 adjacent rail side 65 has been moved into its inoperative position, wherein tool carrying parts 88 with twin picks 82 are retracted into the tubular tool holder all the way to tamping jaw 90, so that the machine may operate in a track section such as shown in FIG. 9, where an obliquely positioned tie 51 prevents immersion of the tamping tool in the adjacent crib at rail side 65 while the tamping tool at rail side 64 is in the extended, operative position.

In FIG. 7, one of ties 51 at the left side shows, in broken lines, a different shape of wooden or concrete tie. Such differently shaped ties and/or their spacing and/or their positioning in relation to each other create difficulties with respect to the proper centering of the tamping tools over the ties to be tamped and/or the immersion of the tamping tools next to these ties, and all of these difficulties are readily overcome with the tamping tool arrangement herein disclosed.

As is schematically indicated in the top view of the two tamping heads 47 of non-stop operating track leveling, lining and tamping machine 48 respectively associated with rails 50 of track 52 in FIG. 11, all remote tamping tools 77 of pairs 66 of opposed tools leading in the operating direction are adjustable between a lowered operative and a raised inoperative position. The tamping head structure has been more fully described hereinabove in connection with FIGS. 7–9. This arrangement makes it possible to operate machine 48 non-stop in the direction of arrow 55 to tamp ballast simultaneously underneath two successive ties while, when track conditions so require, respective ones of the tamping tools may be moved into their inoperative position to enable the operation to proceed with the tamping of single ties. In the latter operation, an advantage is obtained over conventional single-tie tamping because the adjacent tamping tools of the two pairs immersed in a single crib will produce an enhanced ballast compaction in the crib while ballast is also tamped underneath the adjacent tie. The ready and easy change from double-tie to single-tie tamping is of particular importance in non-stop operating machines because they require a rapid and trouble-free succession of tamping cycles involving the intermittent advancement of tamping head 47 while the main frame of machine 48 advances continuously, the tamping head advancing in steps of two ties or one tie, as indicated by arrows 100 and 101.

FIGS. 12, 13 and 14 illustrate track leveling, lining and tamping machine 103 intermittently advancing in an operating direction indicated by arrow 104, the intermittent movements from tamping stage to tamping stage being shown by arrows 132. The machine comprises elongated frame 109 whose ends are supported by swivel trucks 105 on track 108 consisting of rails 106 fastened to ties 107. The machine frame carries power plant 110 and drive 111 moves the machine in the operating direction. Rear operator's cab 112 on the machine frame includes a drive and control panel 113 connected to a central control for driving the machine and operating its tools. Respective tamping head 102 is associated with each rail 106 for simultaneously tamping ballast underneath two successive ties 107, and these tamping heads are mounted on machine frame 109 between swivel trucks 105 within viewing range of control panel 113. Track leveling and lining unit 114 is laterally and vertically movably mounted on the machine frame between the swivel trucks whose distance from each other is sufficient to enable the required track movement for leveling and/or lining to take place between the swivel trucks. Leveling and lining is effected under the control of a suitable reference system whose leveling reference wire 115 is shown in FIG. 12.

Each tamping head comprises two pairs 116, 117 of opposed vibratory tamping tools 122, 123, 124, 125 with twin picks laterally adjacent each side of rails 106 and hydraulic cylinder-piston reciprocating drives 118, 119, 120, 121 connected to the opposed tamping tools. In illustrated machine 103, remote tamping tools 122 of pair 117 of the opposed tamping tools at both rail sides are provided with respective hydraulic cylinder-piston adjustment drives 126 for linearly vertically moving tamping tools 122 between their operative and inoperative positions. Common drive 128 for vibrating the tamping tools and drive 127 for vertically adjusting the common tamping tool carrier are provided for each tamping head. In other words, tamping heads 102 for this intermittently advancing machine for selectively tamping ballast simultaneously underneath two successive ties or underneath a single tie are substantially of the same structure as tamping head 47 illustrated in FIGS. 7–9 and described in detail hereinabove, and also includes fixing devices 129 for rear tamping tools 122 for holding them in their operative positions. As compared to the tamping heads of FIGS. 7–11, the position of the vertically adjustable remote tamping tools of the pairs of opposed tools is reversed, i.e. they are the rear tools, instead of the front tools, in the operating direction indicated by arrow 104.

Machine 103 is illustrated in the operative, lowered position of tamping head 102, in which two successive ties of the previously tamped track section were simultaneously tamped by pairs 116, 117 of the opposed tamping tools in each tamping cycle but in which track 108 is tamped at double tie 130 according to arrow 131 with tamping tools 122 lifted into their inoperative position so that only a single tie is tamped in this tamping cycle since the crib is too narrow to permit immersion of the tamping tools therein. This arrangement is not only simple in structure but has the following advantage: "single" front tools 125 are immersed into the ballast with the vertical adjustment of the tamping head carrier by common drive 127, which assures their penetration into the hard, encrusted ballast 132, which often is difficult because of the considerable resistance of encrusted ballast to the immersion of tamping tools. The adjacent tamping tools 123, 124 of the two pairs then can penetrate into the previously loosened ballast in their common crib. This makes such a machine particularly adapted for work in older tracks which rest on an encrusted ballast bed.

FIG. 14 schematically illustrates the operation of tamping head 102 at a switch section 133 where a branch line and main line merge. Rear tamping tools 122 of pairs 117 of opposed tools at each side of track rail 134 are retracted into their inoperative positions while the rear tamping tools at each side of track rail 135 as well as the other tamping tools 123, 124 and 125 of both tamping heads are in their lowered, operative positions.

With tamping machines of the described and illustrated types, it has for the first time become possible to operate during a first passage of the machine in tamping cycles in which only a single tie is tamped during each cycle while the machine may be returned over the tamped track in a second passage in which two successive ties are simultaneously tamped during each cycle, or vice versa. It is equally possible to work the machine during a single passage selectively in one or the other operating mode. The machine may be adjusted rapidly and simply by the operator for operation in the selected mode. While such a machine requires additional adjustment drives for the remote tamping tools of the pairs of opposed tools, it can be used universally for just about all existing track conditions and configurations to enhance the efficiency of such machines to a great extent, the adjacent tools of the opposed pairs of tamping tools immersed in one crib operating as so-called "spreading" tamping tools when the remote tools of the pairs are in their inoperative position. The outstanding adaptability of the machine enables it to operate in the face of any and all obstacles encountered on one and/or the other side of one or both rails of the track by simply moving a respective tamping tool into its inoperative position to avoid such an obstacle. At the same time, the additional adjustment drives require very little space, which is of considerable importance because other tools must often be arranged in the small available space on tamping machines of this general type.

What is claimed is:

1. A production tamper machine for selectively tamping ballast simultaneously underneath two successive ties or underneath a single tie of a track including a plurality of spaced ties resting on the ballast and defining cribs between adjacent ones of the spaced ties, and rails having a gage side and a field side, the rails being fastened to the ties, the machine comprising a respective tamping head associated with each rail and operative for production tamping, each tamping head comprising (a) a common tamping tool carrier, (b) two pairs of opposed vibratory tamping tools mounted on the common tamping tool carrier laterally adjacent each side of the associated rail, the tamping tools of the pairs of tools on one rail side being transversely aligned with the tamping tools of the pairs of tools on the other rail side, the tamping tools including tamping pick means with tamping jaw means wide enough for effective production tamping, said pairs of tools being spaced from each other in the direction of elongation of the track, with one of the opposed tools of one of the pairs bing adjacent one of the opposed tools of the other pair while the other tools of the pairs of opposed tools are remote from each other, and the spacing between said pairs of tools being such that the adjacent tools of the two pairs may be immersed in a respective one of the cribs defined between the adjacent ties, the opposed tools of each pair being arranged for immersion in the ballast adjacent one of the ties, with the one tie positioned between the opposed tools, and for reciprocation in the direction of elongation of the track, the adjacent tools of the two pairs being vertically fixed in relation to the common tamping tool carrier and the transversely aligned remote tamping tools of at least one of the pairs being adjustable independently fron the other tamping tools for moving said remote tamping tools between a lowered operative position and a raised inoperative position, (c) a respective adjustment drive connected to the vertically adjustable remote tamping tools for moving the same between the operative and inoperative positions, (d) reciprocating drives connected to the opposed tamping tools, (e) a common drive for vibrating the tamping tools, and (f) a drive for vertically adjusting the tamping tool carrier.

2. The production tamper machine of claim 1, wherein each adjustable remote tamping tool comprises a tool holder and the tamping pick means with tamping jaw means is constituted by twin tamping picks with respective tamping jaws mounted on the holder, and the adjustment drive is connected to the holder of the adjustable remote tamping tool for moving the same.

3. The production tamper machine of claim 2, further comprising a pivoting axle bearing the holder of each adjustable remote tamping tool, the axle extending perpendicularly to the direction of reciprocation of the opposed tamping tools whereby the adjustment drive may laterally pivot the adjustable remote tamping tool in a plane extending perpendicularly to the direction of reciprocation of the opposed tamping tools.

4. The production tamper machine of claim 2, wherein only the remote tamping tools of one of the pairs of the opposed tamping tools trailing in an operating direction is adjustable.

5. The production tamper machine of claim 2, wherein the drives are hydraulically operated.

6. The production tamper machine of claim 2, wherein the reciprocating drives connected to the adjacent tamping tools of the pairs of opposed tools are adapted to move the adjacent tamping tools to an end position wherein the adjacent tools are closest to each other and to be blocked in said end position.

7. The production tamper machine of claim 6, wherein the tamping pick means of the adjacent tamping tools are cranked to enable the adjacent tamping tools to assume said end position wherein the cranked tamping pick means overlap in the direction of elongation of the track.

8. The production tamper machine of claim 1, wherein each adjustment drive is operable by remote control independently of any other adjustment drive and of the drive for vertically adjusting the tamping tool carrier.

9. The production tamper machine of claim 1, wherein the adjustment drive is arranged for linear vertical movement of the remote tamping tool.

10. A tamping head for a production tamper machine and operative for production tamping ballast simultaneously underneath two successive ties or underneath a single tie of a track including a plurality of spaced ties resting on the ballast and defining cribs between adjacent ones of the spaced ties, and rails having a gage side and a field side, the rails being fastened to the ties, the tamping head being associated with one of the rails and comprising (a) a common tamping tool carrier, (b) two pairs of opposed vibratory tamping tools mounted on the common tamping tool carrier laterally adjacent each of the sides of the rails, the tamping tools of the pairs of tools on one rail side being transversely aligned with the tamping tools of the pairs of tools on the other rail side, the tamping tools including tamping pick means with tamping jaw means wide enough for effective production tamping, said pairs of tools being spaced from each other in the direction of elongation of the track, with one of the opposed tools of one of the pairs being adjacent one of the opposed tools of the other pair while the other tools of the pairs of opposed tools are remote from each other and the spacing between said pairs of tools being such that the adjacent tools of the two pairs may be immersed in a respective one of the cribs defined between the adjacent ties, the opposed tools of each pair being arranged for immersion in the ballast adjacent one of the ties, with the one tie positioned between the opposed tools, and for reciprocation in the direction of elongation of the track, the adjacent tools of the two pairs being vertically fixed in relation to the common tamping tool carrier and the transversely aligned remote tamping tools of at least one of the pairs being adjustable independently from the other tamping tools for moving said remote tamping tools between a lowered operative position and a raised inoperative position, (c) a respective adjustment drive connected to the vertically adjustable remote tamping tools for moving the same between the operative and inoperative positions, (d) reciprocating drives connected to the opposed tamping tools, (e) a common drive for vibrating the tamping tools, and (f) a drive for vertically adjusting the tamping tool carrier.

11. The tamping head of claim 10, wherein the transversely aligned remote tamping tools of the pairs of opposed tamping tools leading in an operating direction are adjustable, and each adjustment drive is operable by remote control independently of the other adjustment drives and of the drive for vertically adjusting the tamping tool carrier.

12. The tamping head of claim 10, wherein the transversely aligned remote tamping tools of the pairs of opposed tamping tools trailing in an operating direction are adjustable, and each adjustment drive is operable by remote control independently of the other adjustment drives and of the drive for vertically adjusting the tamping tool carrier.

13. The tamping head of claim 10, wherein each tamping tool comprises a tool holder and the tamping pick means with tamping jaw means is constituted by twin tamping picks with respective tamping jaws mounted on the holder, and the adjustment drives are connected to the holder of the adjustable remote tamping tools for moving the same.

14. The tamping head of claim 10, wherein the adjustable remote tamping tool comprises a tubular tamping tool holder pivotally mounted on the common tamping tool carrier and vertically displaceably holding the tamping tool, and the adjustment drive is an hydraulically operated cylinder-piston jack affixed thereto.

15. The tamping head of claim 14, further comprising a connecting bracket affixed to the holder and pivoted to the common tamping tool carrier, and the bracket being linked to a respective one of the reciprocating drives for the adjustable tamping tool for pivoting the holder.

16. The tamping head of claim 15, further comprising an additional connecting bracket affixed to the holder diametrically opposite the first-named bracket and mounting the first-named cylinder-piston jack.

17. The tamping head of claim 15, further comprising a fixing device for holding the vertically adjustable remote tamping tool respectively in the operative and inoperative position thereof.

18. The tamping head of claim 17, wherein the fixing device comprises a portion of the tubular holder surrounding the tamping tool and capable of clamping the tamping tool in the operative position, and mating flanges affixed to the tubular holder portion, the flanges being movable towards each other for tightening the tubular holder portion around the tamping tool whereby the tamping tool is clamped in position.

19. The tamping tool of claim 18, further comprising an hydraulically operated cylinder-piston jack for moving the flanges towards each other for tightening the tubular holder portion around the tamping tool.

20. The tamping tool of claim 19, wherein the tubular holder portion defines a longitudinally extending slot facilitating the tightening of the tubular holder portion.

21. The tamping head of claim 14, further comprising a cross connection connecting the piston of the jack to an upper end of the tamping tool.

22. The tamping head of claim 21, wherein the adjustable remote tamping tool is comprised of twin tool carrying parts, the tamping pick means with tamping jaw means is constituted by twin tamping picks replaceably mounted on the tool carrying parts and tamping jaws replaceably mounted on lower ends of the picks, and further comprising a common bushing vertically displaceably bearing the twin tool carrying parts, the twin tool carrying parts having upper ends connected to the cross connection, and the cylinder-piston jack adjustment drive having a stroke enabling the twin tool carrying parts to be telescopingly lowered out of the tubular holder and retracted thereinto until the tamping jaws are positioned within the holder.

* * * * *